US007473325B2

(12) United States Patent
Yoshizawa et al.

(10) Patent No.: US 7,473,325 B2
(45) Date of Patent: Jan. 6, 2009

(54) CURRENT TRANSFORMER CORE, CURRENT TRANSFORMER AND POWER METER

(75) Inventors: Yoshihito Yoshizawa, Saitama-ken (JP); Masamu Naoe, Saitama-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 27 days.

(21) Appl. No.: 11/721,941

(22) PCT Filed: Dec. 16, 2005

(86) PCT No.: PCT/JP2005/023181

§ 371 (c)(1),
(2), (4) Date: Jun. 15, 2007

(87) PCT Pub. No.: WO2006/064920

PCT Pub. Date: Jun. 22, 2006

(65) Prior Publication Data

US 2008/0129437 A1 Jun. 5, 2008

(30) Foreign Application Priority Data

Dec. 17, 2004 (JP) ..... 2004-365957

(51) Int. Cl.
*H01F 1/00* (2006.01)
*H01F 27/02* (2006.01)

(52) U.S. Cl. ..... 148/312; 148/303; 148/306; 148/313; 336/83

(58) Field of Classification Search ..... 252/62.56, 252/62.57, 62.58, 62.59; 148/303, 304, 306, 148/313; 420/34, 45, 49, 50, 51, 58, 60, 420/64, 73, 74, 76, 90–91, 97–98, 104, 112, 420/117, 118, 119, 120–121; 336/180, 182, 336/83

See application file for complete search history.

(56) References Cited

U.S. PATENT DOCUMENTS

| | | | | |
|---|---|---|---|---|
| 5,252,148 | A * | 10/1993 | Shigeta et al. | 148/307 |
| 5,449,419 | A * | 9/1995 | Suzuki et al. | 148/306 |
| 5,522,948 | A * | 6/1996 | Sawa et al. | 148/308 |
| 5,741,373 | A * | 4/1998 | Suzuki et al. | 148/306 |
| 6,425,960 | B1 | 7/2002 | Yoshizawa et al. | |
| 6,507,262 | B1 | 1/2003 | Otte et al. | |
| 6,563,411 | B1 | 5/2003 | Otte et al. | |
| 6,648,990 | B2 * | 11/2003 | Yoshizawa | 148/313 |
| 7,061,355 | B2 * | 6/2006 | Tanaka et al. | 336/175 |
| 7,141,127 | B2 * | 11/2006 | Yoshizawa | 148/307 |

FOREIGN PATENT DOCUMENTS

| | | |
|---|---|---|
| JP | 64-079342 | 3/1989 |
| JP | 01-235213 | 9/1989 |

(Continued)

*Primary Examiner*—Anh T Mai
(74) *Attorney, Agent, or Firm*—Sughrue Mion, PLLC

(57) ABSTRACT

A current transformer core made of an alloy having a composition represented by the general formula: $Fe_{100-x-a-y-c}M_xCu_aM'_yX'_c$ (by atomic %), wherein M is Co and/or Ni, M' is at least one element selected from the group consisting of V, Ti, Zr, Nb, Mo, Hf, Ta and W, X' is Si and/or B, and x, a, y and c are numbers satisfying $10 \leqq x \leqq 50$, $0.1 \leqq a \leqq 3$, $1 \leqq y \leqq 10$, $2 \leqq c \leqq 30$, and $7 \leqq y+c \leqq 31$, respectively; at least part or all of the alloy structure being composed of crystal grains having an average particle size of 50 nm or less.

12 Claims, 5 Drawing Sheets

FOREIGN PATENT DOCUMENTS

| | | | |
|---|---|---|---|
| JP | 01-242755 | | 9/1989 |
| JP | 03-271346 | A | 12/1991 |
| JP | 05-203679 | | 8/1993 |
| JP | 09-050907 | A | 2/1997 |
| JP | 2000-119821 | A | 4/2000 |
| JP | 2000-252111 | A | 9/2000 |
| JP | 2001-52933 | A | 2/2001 |
| JP | 2001-155946 | A | 6/2001 |
| JP | 2002-525863 | A | 8/2002 |
| JP | 2002-530854 | A | 9/2002 |
| JP | 2004-218037 | A | 8/2004 |
| JP | 2004-353090 | A | 12/2004 |

* cited by examiner

CURRENT TRANSFORMER CORE, CURRENT TRANSFORMER AND POWER METER

FIELD OF THE INVENTION

The present invention relates to a current transformer core suitable for detecting unsymmetrical-waveform alternating current such as half-wave, sinusoidal, alternating current, etc. and direct-current-superimposed alternating current, and a current transformer and a power meter using such core.

BACKGROUND OF THE INVENTION

Power meters used to detect the power consumption of electric appliances and facilities at homes and in industry are categorized into induction-type power meters and electronic power meters. Although induction-type power meters comprising rotating disks were conventionally predominant, the electronic power meters are recently finding wider use due to the development of electronics. Power meters adapted to conventional standards such as IEC62053-22, etc. cannot conduct the accurate detection of distorted-waveform current such as half-wave, sinusoidal, alternating current, etc., failing to measure power accurately. Accordingly, IEC62053-21, a power meter standard adapted to distorted waveforms (half-wave rectified waveforms), was enacted in Europe. In other countries than those in Europe, too, power meters such as present rotating-disk meters, etc. failing to accurately measure the power of distorted waveforms were discarded, and power meters adapted to IEC62053-21, which use current transformers (CTs) or Hall elements for current detection, have been being put to actual use. In the industrial fields such as inverters, etc., too, the current transformers have important role in the detection of distorted-waveform alternating current and direct-current-superimposed alternating current.

A current sensor using a Hall element comprises a Hall element disposed in a gap of a magnetic core, and a conductive wire for flowing current to be measured, which penetrates through a closed magnetic circuit of the magnetic core, to detect a magnetic field generated in the gap, which is substantially proportional to the current, by the Hall element, thereby detecting the current.

The current transformer (CT) usually comprises a magnetic core having a closed magnetic circuit, a primary winding for flowing current to be measured, which penetrates through the closed magnetic circuit, and a secondary winding in a relatively large number of turns. FIG. 8 shows the structure of a current transformer (CT)-type current sensor. The magnetic core is in a ring-type or assembled core-type shape, and a ring-type, toroidal core with windings can be made smaller with a reduced magnetic flux leakage, thereby enabling performance near a theoretical operation.

Ideal output current i obtained from alternating through-current $I_0$ under the condition of $R_L << 2\pi f \cdot L_2$ is $I_0/N$, wherein N is the number of a secondary winding, and output voltage $E_0$ is $I_0 \cdot R_L/N$, wherein R is load resistance. The output voltage $E_0$ is actually smaller than the ideal value due to a core loss, a leaked magnetic flux, etc. The sensitivity of the current transformer corresponds to $E_0/I_0$, but this value is actually determined by a coupling coefficient of primary and secondary windings. $E_0 = I_0 \cdot R_L \cdot K/N$ is satisfied, wherein K is a coupling coefficient.

Although the coupling coefficient K is 1 in an ideal current transformer, K is about 0.95-0.99 in actual current transformers at $R_L$ of 100Ω or less, under the influence of the internal resistance of windings, load resistance, a leaked magnetic flux, the non-linearity of a permeability, etc. Because the K value is low if there is a gap in a magnetic circuit, a toroidal core with no gap can provide an ideal current transformer having the largest degree of coupling. The larger cross section area S, the larger number N of a secondary winding, and the smaller load resistance $R_L$ provide the K value closer to 1. This K value also varies depending on the through-current $I_0$. In the case of micro-current $I_0$ of 100 mA or less, the K value tends to be low. Particularly when a low-permeability material is used for the magnetic core, this tendency is large. Accordingly, when the micro-current should be measured at high accuracy, a high-permeability material is used for the magnetic core.

A ratio error is a relative error of the measured value to the ideal value at each measurement point, indicating how the measured current is accurate. The coupling coefficient is correlated with the ratio error. A phase difference represents the accuracy of a waveform, indicating the phase deviation of the output waveform from the original waveform. The current transformer output usually has a leading phase. These two characteristics are particularly important to the current transformers used for integrating power meters, etc.

In the current transformer that should measure micro-current, materials having high initial permeability such as Parmalloy, etc. are generally used to have a high coupling coefficient K, and small ratio error and phase difference. The maximum through-current $I_{0_{max}}$ of the current transformer is defined as the maximum current with secured linearity, which is affected by load resistance, internal resistance, and the magnetic properties of core materials used. To enable the measurement of large current, the core materials preferably have as high saturation magnetic flux density as possible.

Known materials used for the current transformer cores include silicon steel, Parmalloy, amorphous alloys, Fe-based, nano-crystalline alloys, etc. Because inexpensive, high-magnetic-flux-density silicon steel sheets have low permeability, large hysteresis, and poor magnetization loop linearity, they suffer largely varying ratio error and phase difference, resulting in difficulty in providing high-accuracy current transformers. Further, having a large residual magnetic flux density, they cannot easily conduct the accurate measurement of unsymmetrical current such as half-wave, sinusoidal, current, etc.

The Fe-based amorphous alloys suffer large variations of a ratio error and a phase difference when used for the current transformer. JP 2002-525863 A discloses that because a Co-based, amorphous alloy heat-treated in a magnetic field has good magnetization curve linearity and small hysteresis, it exhibits excellent characteristics when used for a current transformer (CT) for detecting unsymmetrical-waveform current. Co-based, amorphous alloys having as low permeability as about 1500 and good magnetization curve linearity are used for current transformers (CTs) for current detection, which are adapted to the above IEC62053-21, a standard of power meters. However, the saturation magnetic flux densities of the Co-based, amorphous alloys are insufficiently as low as 1.2 T or less, and they are thermally unstable. Thus, there are problems as follows: the measurement is limited when biased with large current; they are not necessarily sufficient in size reduction and stability; and because their permeability cannot be increased so high from the aspect of magnetic saturation in view of direct current superposition, they have large ratio error and phase difference, important characteristics for current transformers. In addition, the Co-based, amorphous alloys are disadvantageous in cost because they contain a large amount of expensive Co.

Materials having relatively high permeability such as Parmalloy, etc. are used for current transformer cores in integrating power meters adapted to the conventional standards of IEC62053-22, etc. Such high-permeability materials can measure the power of positive-negative-symmetrical current and voltage waveform, but cannot measure the power of unsymmetrical-waveform current and distorted-waveform current accurately.

The Fe-based, nano-crystalline alloys having high permeability and excellent soft magnetic properties are used for magnetic cores of common-mode choke coils, high-frequency transformers, pulse transformers, etc. The typical compositions of the Fe-based, nano-crystalline alloys are Fe—Cu—(Nb, Ti, Zr, Hf, Mo, W, Ta)—Si—B, Fe—Cu—(Nb, Ti, Zr, Hf, Mo, W, Ta)—B, etc. described in JP 4-4393 B and JP 1-242755 A. These Fe-based, nano-crystalline alloys are usually produced by forming amorphous alloys from a liquid or gas phase by rapid quenching, and heat-treating them for micro-crystallization. It is known that the Fe-based, nano-crystalline alloys have as high saturation magnetic flux density and as low magnetostriction as those of the Fe-based amorphous alloys, meaning excellent soft magnetic properties. JP 1-235213 A, JP 5-203679 A and JP 2002-530854 A describe that the Fe-based, nano-crystalline materials are suitable for current sensors (current transformers) used in leakage circuit breakers, integrating power meters, etc.

However, current transformer cores made of high-permeability materials such as conventional Parmalloy and Fe-based, nano-crystalline, soft-magnetic alloys full to detect current sufficiently because of magnetic saturation, particularly in the case of direct current bias. The cores of the Fe-based, nano-crystalline, soft-magnetic alloys having high saturation magnetic flux density and permeability are suitable for current transformers such as leakage circuit breakers, etc., but they have so small $H_K$ that they cannot easily measure current in the case of direct current bias because of their magnetic saturation. In the case of a current transformer used for half-wave, sinusoidal, current, direct current of $I_{max}/2\pi$ is superimposed, where $I_{max}$ is a peak value of the half-wave, sinusoidal, current. Accordingly, the current transformer cores made of the conventional Fe-based, nano-crystalline, soft-magnetic alloys described in JP2002-530854 A, etc., which have as high permeability as 12000 or more, are magnetically saturated because of direct-current magnetic field bias. Thus, they are not suitable for the measurement of such unsymmetrical-waveform current.

Demand has thus become mounting for a magnetic material making it possible to measure the power of unsymmetrical-waveform current accurately. Even when unsymmetrical-waveform current such as half-wave, sinusoidal, current and direct current are superimposed, the accurate measurement of alternating current is demanded. Necessary to meet such demand is a current transformer core made of a magnetic material having a low residual magnetic flux density, small hysteresis, and good magnetization curve linearity, which is not easily saturable and generates a relatively large anisotropic magnetic field $H_K$.

OBJECTS OF THE INVENTION

Accordingly, an object of the present invention is to provide a current transformer core capable of accurately measuring the power of unsymmetrical-waveform current and distorted waveform current.

Another object of the present invention is to provide a small, inexpensive, thermally stable current transformer core with a wide current-measuring range.

A further object of the present invention is to provide a current transformer and a power meter using such magnetic core.

DISCLOSURE OF THE INVENTION

As a result of intense research in view of the above objects, the inventors have found that (a) an Fe-based, nano-crystalline alloy containing increased amounts of Co and/or Ni, at least part or all of its structure being composed of crystal grains having an average particle size of 50 nm or less, has a magnetic flux density $B_{8000}$ of 1.2 T or more at 8000 $Am^{-1}$, an anisotropic magnetic field $H_K$ of 150-1500 $Am^{-1}$, a squareness ratio $B_r/B_{8000}$ of 5% or less, and an alternating-current specific initial permeability $\mu_r$ of 800-7000 at 50 Hz and 0.05 $Am^{-1}$, and that (b) a core made of this alloy exhibits excellent characteristics when used for a current transformer for detecting unsymmetrical-waveform current and direct-current-biased current. The present invention has been completed based on such findings.

Thus, the current transformer core of the present invention is made of an alloy having a composition represented by the general formula: $Fe_{100-x-a-y-c}M_xCu_aM'_yX'_c$ (by atomic %), wherein M is Co and/or Ni, M' is at least one element selected from the group consisting of V, Ti, Zr, Nb, Mo, Hf, Ta and W, X' is Si and/or B, and x, a, y and c are numbers satisfying $10 \leqq x \leqq 50$, $0.1 \leqq a \leqq 3$, $1 \leqq y \leqq 10$, $2 \leqq c \leqq 30$, and $7 \leqq y+c \leqq 31$, respectively; at least part or all of the alloy structure being composed of crystal grains having an average particle size of 50 nm or less; and said alloy having a magnetic flux density $B_{8000}$ of 1.2 T or more at 8000 $Am^{-1}$, an anisotropic magnetic field $H_K$ of 150-1500 $Am^{-1}$, a squareness ratio $B_r/B_{8000}$ of 5% or less, and an alternating-current specific initial permeability $\mu_r$ of 800-7000 at 50 Hz and 0.05 $Am^{-1}$.

In the current transformer core of the present invention, the M content x preferably meets $15 \leqq x \leqq 40$. The B content is preferably 4-12 atomic %. The Si content is preferably 0.5-17 atomic %.

In the current transformer core of the present invention, part of M' may be substituted by at least one element selected from the group consisting of Cr, Mn, Sn, Zn, In, Ag, Au, Sc, platinum-group elements, Mg, Ca, Sr, Ba, Y, rare earth elements, N, O and S. Part of X' may be substituted by at least one element selected from the group consisting of C, Ge, Ga, Al, Be and P.

The current transformer core of the present invention can be produced by a heat treatment in a magnetic field, which comprises keeping it at a temperature of 450-700° C. for 24 hours or less while applying a magnetic field of 40 $kAm^{-1}$ or more in the core height direction, and then cooling it to room temperature.

The current transformer core of the present invention is preferably used to detect half-wave, sinusoidal, alternating current.

The current transformer of the present invention comprises the above core, a primary winding, at least one secondary detection winding, and a load resistor parallel-connected to said secondary detection winding.

In the current transformer of the present invention, the primary winding preferably has 1 turn. It preferably has a phase difference within 5° in a rated current range, and a ratio error within 3% (absolute value) at 23° C.

The power meter of the present invention multiplies the current value obtained by the above current transformer and voltage at that time to calculate power used.

DESCRIPTION OF THE BEST MODE OF THE INVENTION

[1] Fe-Based, Nano-Crystalline Alloy (1) Composition

Figure 1:
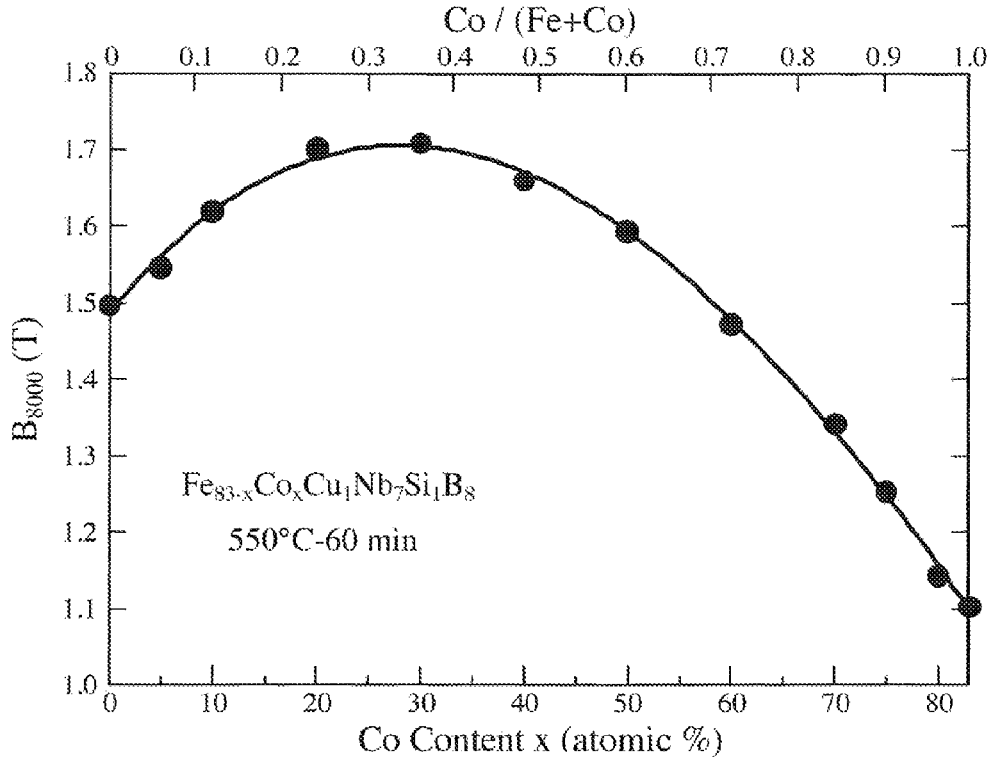
FIG. 1 is a graph showing the magnetic flux density $B_{8000}$ of an alloy of $Fe_{83-x}Co_xCu_1Nb_7Si_1B_8$ (by atomic %) at 8000 $Am^{-1}$, which is used for the magnetic core of the present invention for a current transformer.
Figure 2:
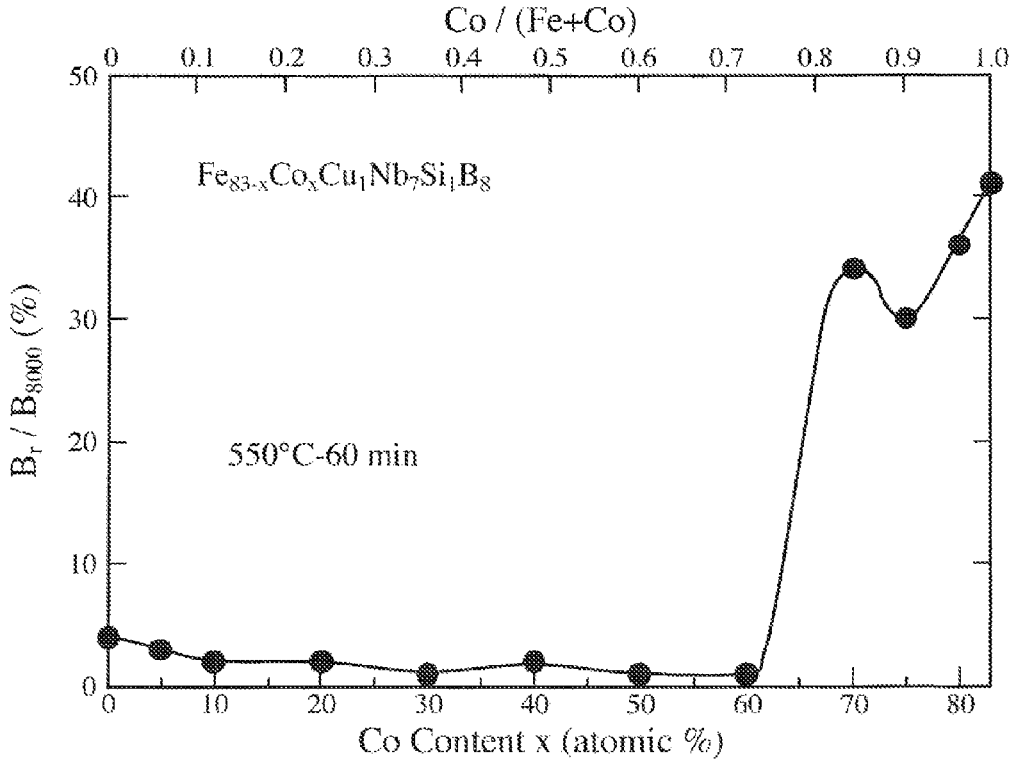
FIG. 2 is a graph showing the squareness ratio $B_r/B_{8000}$ of an alloy of $Fe_{83-x}Co_xCu_1Nb_7Si_1B_8$ (by atomic %), which is used for the magnetic core of the present invention for a current transformer.
Figure 3:
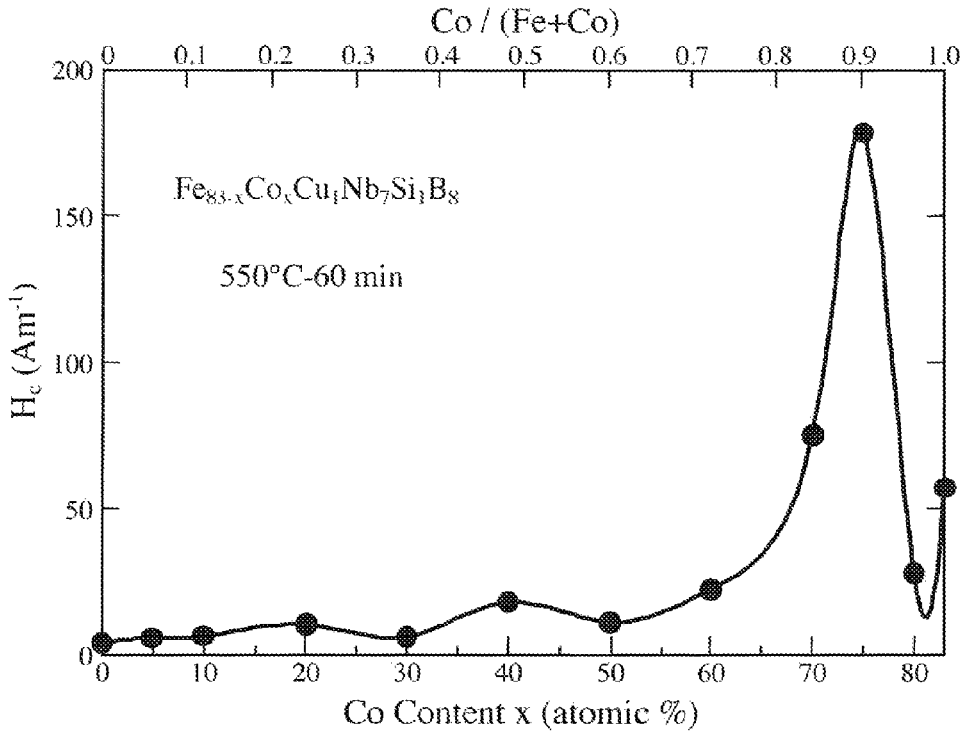
FIG. 3 is a graph showing the coercivity $H_c$ of an alloy of $Fe_{83-x}Co_xCu_1Nb_7Si_1B_8$ (by atomic %), which is used for the magnetic core of the present invention for a current transformer.
Figure 4:
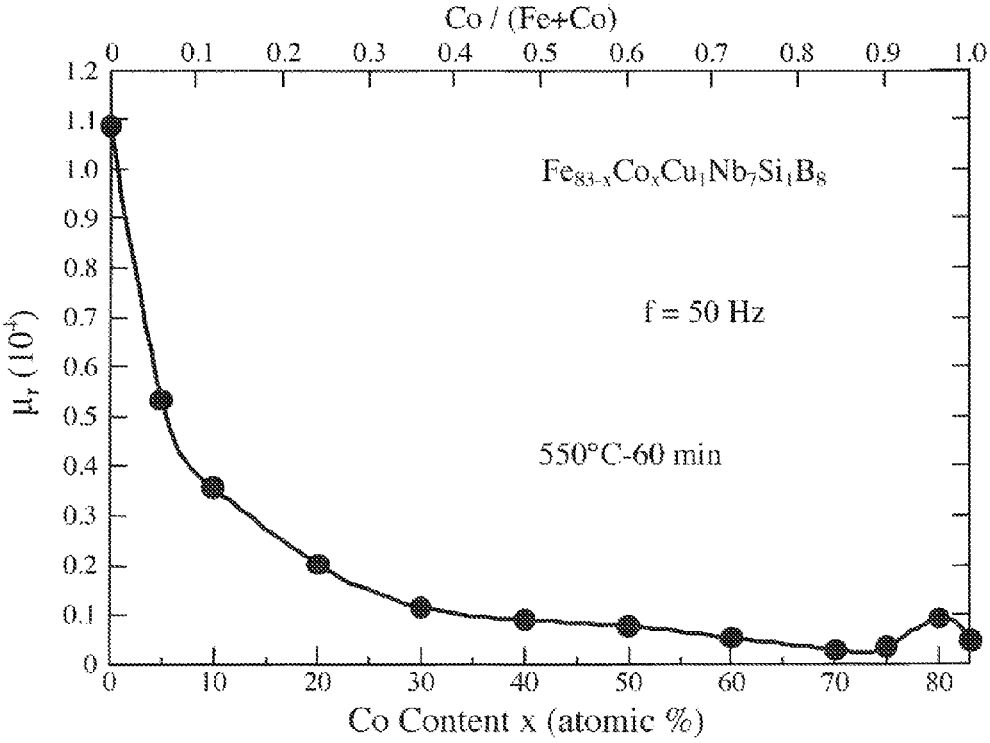
FIG. 4 is a graph showing the alternating-current specific initial permeability $\mu_r$ of an alloy of $Fe_{83-x}Co_xCu_1Nb_7Si_1B_8$ (by atomic %) at 50 Hz and 0.05 $Am^{-1}$, which is used for the magnetic core of the present invention for a current transformer.
Figure 5:
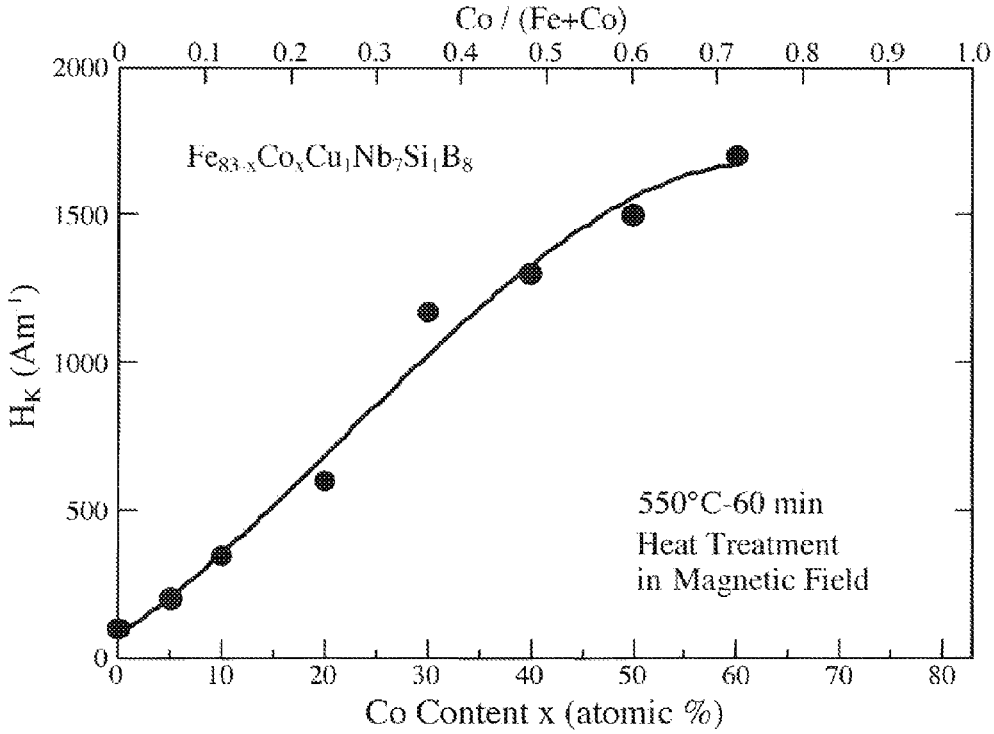
FIG. 5 is a graph showing the anisotropic magnetic field $H_K$ of an alloy of $Fe_{83-x}Co_xCu_1Nb_7Si_1B_8$ (by atomic %), which is used for the magnetic core of the present invention for a current transformer.

The Fe-based, nano-crystalline alloy for the current transformer core of the present invention has a composition represented by the general formula: $Fe_{100-x-a-y-c}M_xCu_aM'_yX'_c$ (by atomic %), wherein M is Co and/or Ni, M' is at least one element selected from the group consisting of V, Ti, Zr, Nb, Mo, Hf, Ta and W, X' is Si and/or B, and x, a, y and c are numbers satisfying $10 \leqq x \leqq 50$, $0.1 \leqq a \leqq 3$, $1 \leqq y \leqq 10$, $2 \leqq c \leqq 30$, and $7 \leqq y+c \leqq 31$ respectively.

M is Co and/or Ni, having functions of increasing induced magnetic anisotropy, improving the linearity of a B—H loop, adjusting an anisotropic magnetic field $H_K$, and enabling operation as a current transformer even with biased direct current in cases where half-wave, sinusoidal, alternating current, etc. are measured, etc. The M content x meets $10 \leqq x \leqq 50$. When x is less than 10 atomic %, $H_K$ is so small that the magnetic core is saturated when direct current is superimposed, resulting in difficulty in current measurement. When x exceeds 50 atomic %, $H_K$ becomes too large, resulting in too much increase in the absolute values of a phase difference and a ratio error. The M content x meets preferably $15 \leqq x \leqq 40$, more preferably $18 \leqq x \leqq 37$, most preferably $22 \leqq x \leqq 35$. The x in a range of 10-50 provides a high-accuracy, well-balanced current transformer, because accurate current measurement can be conducted even when direct current is superimposed.

The Cu content $\alpha$ meets $0.1 \leqq \alpha \leqq 3$. When $\alpha$ is less than 0.1 atomic %, there is a large phase difference. When $\alpha$ exceeds 3 atomic %, the core material becomes brittle, resulting in difficulty in forming the magnetic core. The Cu content $\alpha$ preferably meets $0.3 \leqq \alpha \leqq 2$.

M' is an element for accelerating the formation of an amorphous phase. M' is at least one element selected from the group consisting of V, Ti, Zr, Nb, Mo, Hf, Ta and W, and its amount y is in a range of $1 \leqq y \leqq 10$. When y is less than 1 atomic %, a fine crystal grain structure cannot be obtained after heat treatment, resulting in increase in the absolute values of a phase difference and a ratio error. When y exceeds 10 atomic %, $H_K$ decreases because of drastic decrease in a saturation magnetic flux density, resulting in difficulty in current measurement by magnetic saturation in the case of direct current bias. The preferred M' content y meets $1.5 \leqq y \leqq 9$.

X' is also an element for accelerating the formation of an amorphous phase. X' is Si and/or B, and its amount c is in a range of $2 \leqq c \leqq 30$. When the X' content c is less than 2 atomic %, the absolute values of a phase difference and a ratio error increase. When it exceeds 30 atomic %, $H_K$ decreases because of drastic decrease in a saturation magnetic flux density, resulting in difficulty in current measurement by magnetic saturation in the case of direct current bias. The X' content c meets preferably $5 \leqq c \leqq 25$, more preferably $7 \leqq c \leqq 24$.

The sum of the M' content y and the X' content c meets the condition of $7 \leqq y+c \leqq 31$. When y+c is less than 7 atomic %, the phase difference is extremely large. When it exceeds 31 atomic %, the saturation magnetic flux density decreases. y+c meets preferably $10 \leqq y+c \leqq 28$, more preferably $13 \leqq y+c \leqq 27$.

Particularly when the B content is 4-12 atomic %, a current transformer core with a small phase difference is preferably obtained. The B content is particularly 7-10 atomic %. When the Si content is 0.5-17 atomic %, the absolute values of a phase difference and a ratio error are so small that high-accuracy current measurement can be conducted even when biased with half-wave sinusoidal or direct current during measuring alternating current. The Si content is particularly 0.7-5 atomic %.

To adjust the corrosion resistance, the phase difference and the ratio error of the alloy, part of M' may be substituted by at least one element selected from the group consisting of Cr, Mn, Sn, Zn, In, Ag, Au, Sc, platinum-group elements, Mg, Ca, Sr, Ba, Y, rare earth elements, N, O and S, and to adjust the phase difference and the ratio error, part of X' may be substituted by at least one element selected from the group consisting of C, Ge, Ga, Al, Be and P.

(2) Production Method

The current transformer core of the present invention is produced by rapidly quenching an alloy melt having said composition by a rapid quenching method such as a single roll method, etc. to form a thin amorphous alloy ribbon, slitting the ribbon if necessary, winding it to a toroidal core, heat-treating the toroidal core at a crystallization temperature or higher to form fine crystals having an average particle size of 50 nm or less. Although the thin amorphous alloy ribbon before heat treatment preferably does not contain a crystal phase, it may partially contain a crystal phase. Although the rapid quenching method such as a single roll method, etc. may be conducted in the atmosphere when no active metals are contained, it is conducted in an inert gas such as Ar, He, etc. or in vacuum when active metals are contained. It may also be produced in an atmosphere containing a nitrogen gas, a carbon monoxide gas or a carbon dioxide gas. The surface roughness Ra of the thin alloy ribbon is preferably as small as possible. Specifically, it is preferably 5 μm or less, more preferably 2 μm or less.

When an insulating layer is formed on at least one surface of the thin alloy ribbon by coating of $SiO_2$, MgO, $Al_2O_3$, etc., a chemical conversion treatment, an anode oxidation treatment, etc., if necessary, high accuracy is achieved in the measurement of current containing high-frequency components. The thickness of the insulating layer is preferably 0.5 μm or less, to avoid decrease in core space factor.

After the thin amorphous alloy ribbon is wound to form a toroidal core, heat treatment is conducted in an inert gas such as an argon gas, a helium gas, a nitrogen gas, etc. or in vacuum to obtain a magnetic core with little performance variation. A magnetic field having enough intensity to saturate the alloy (for instance, 40 $kAm^{-1}$ or more) is applied during at least part of the heat treatment, to provide the core with magnetic anisotropy. The direction of a magnetic field applied is aligned with the height of a toroidal core. The magnetic field applied may be a direct-current magnetic field, an alternating-current magnetic field, or a pulse magnetic field. The magnetic field is usually applied at a temperature of 200° C. or higher for 20 minutes or more. Also, the magnetic field is applied during temperature elevation, keeping at a constant temperature and cooling, to provide a current transformer with a small squareness ratio, improved linearity of the B—H loop, and small absolute values of a phase difference and a ratio error. On the contrary, when no magnetic field is applied during the heat treatment, the resultant current transformer has extremely poor performance.

The highest temperature during the heat treatment is a crystallization temperature or higher, specifically 450-700° C. In the case of a heat treatment pattern comprising a constant-temperature period, the constant-temperature period is usually 24 hours or less, preferably 4 hours or less from the aspect of mass production. An average temperature-elevating speed is preferably 0.1-100° C./minute, more preferably 0.1-50° C./minute, during the heat treatment. An average cooling speed is preferably 0.1-50° C./minute, more preferably 0.1-10° C./minute. The cooling is conducted to room temperature. This heat treatment provides the current transformer with particularly improved B—H loop linearity, small phase difference, and small absolute value variation of a ratio error.

The heat treatment may be conducted by one step or many steps. When a large magnetic core is heat-treated, or when many magnetic cores are heat-treated, it is preferable to proceed crystallization slowly by elevating the temperature at a low speed near the crystallization temperature, or keeping the temperature near the crystallization temperature. This is to avoid that the temperature of the magnetic core is elevated too much by heat generation during the crystallization, leading to the deterioration of characteristics. The heat treatment is preferably conducted in an electric furnace, but the alloy may be heated by flowing direct current, alternating current or pulse current through the alloy.

The resultant magnetic core is preferably contained in a stress-free insulating case of phenol resins, etc. to avoid the deterioration of performance, but it may be impregnated or coated with a resin, if necessary. A detection wire is wound around the case containing the magnetic core to provide a current transformer. The current transformer core of the present invention exhibits the maximum performance for direct-current-superimposed current, particularly suitable for a current transformer for an integrating power meter adapted to IEC62053-21, a standard usable for distorted waveform.

(3) Crystal Structure

The Fe-based, nano-crystalline alloy for the current transformer core of the present invention has crystal grains having an average particle size of 50 nm or less at least partially or entirely. The percentage of the crystal grains is preferably 30% or more, more preferably 50% or more, particularly 60% or more, of the alloy structure. An average crystal grain size desirable for providing the current transformer core with small absolute values of a phase difference and a ratio error is 2-30 nm.

The crystal grains in the Fe-based, nano-crystalline alloy have a body-cubic crystal (bcc) structure mainly based on FeCo or FeNi, in which Si, B, Al, Ge, Zr, etc. may be dissolved, and which may have a regular lattice. Also, the alloy may partially have a face-center cubic (fcc) phase containing Cu. The alloy is preferably free from a compound phase, but it may contain the compound phase if it is in a small amount.

When the alloy has a phase other than the crystal grains, that phase is mainly an amorphous phase. The existence of the amorphous phase around crystal grains suppresses the crystal grains from growing, thereby making them finer, and providing the alloy with higher resistivity and smaller magnetization hysteresis. Thus, the current transformer is provided with improved phase difference.

(4) Properties (a) Magnetic Flux Density

The Fe-based, nano-crystalline alloy should have a magnetic flux density $B_{8000}$ at 8000 $Am^{-1}$ of 1.2 T or more. When $B_{8000}$ is less than 1.2 T, an anisotropic magnetic field $H_K$ cannot be increased, so that the current transformer fails to exhibit sufficient characteristics in applications in which large direct-current bias is used, or in applications in which large current is measured. By adjusting the alloy composition, $B_{8000}$ can be 1.6 T or more, further 1.65 T or more.

(b) Anisotropic Magnetic Field

Figure 9:
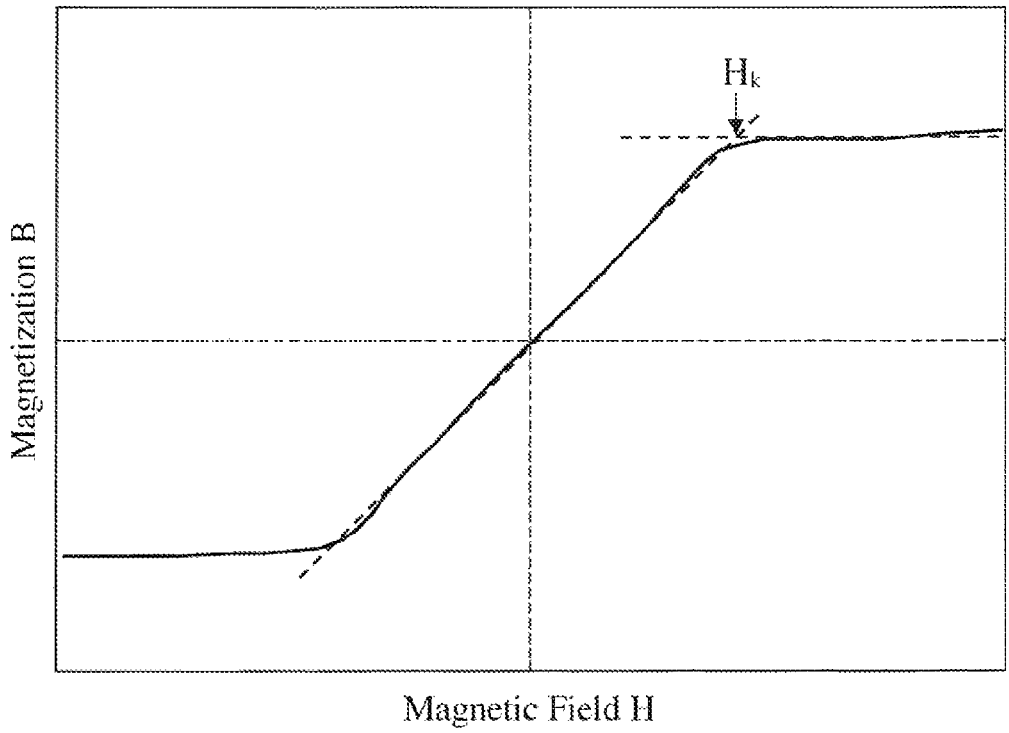
FIG. 9 is a graph showing an anisotropic magnetic field $H_K$ in a B—H loop in the difficult magnetization axis of the current transformer core.

The anisotropic magnetic field $H_K$ is a physical parameter indicating the saturated magnetic field of a magnetic core, which corresponds to a magnetic field at a flexion of the B—H loop, as shown in FIG. 9. The current transformer core of the present invention has an anisotropic magnetic field $H_K$ of 150-1500 $Am^{-1}$. With an anisotropic magnetic field $H_K$ in this range in addition to a high saturation magnetic flux density, the current transformer core has a B—H loop with small hysteresis and excellent linearity.

(c) Squareness Ratio

The Fe-based, nano-crystalline alloy should have a squareness ratio $B_r/B_{8000}$ of 5% or less. When $B_r/B_{8000}$ exceeds 5%, the current transformer has large absolute values of a phase difference and a ratio error, resulting in deteriorated characteristics, and more variations of current detection characteristics after the measurement of large current. By adjusting the alloy composition, $B_r/B_{8000}$ can be 3% or less, further 2.5% or less. $B_r$ represents a residual magnetic flux density, and $B_{8000}$ represents a magnetic flux density when a magnetic field of 8000 $Am^{-1}$ is applied.

(d) Alternating-Current Specific Initial Permeability

The Fe-based, nano-crystalline alloy has an alternating-current specific initial permeability $\mu_r$ of 800-7000 at 50 Hz and 0.05 $Am^{-1}$. The current transformer core made of the Fe-based, nano-crystalline alloy having such alternating-current specific initial permeability $\mu_r$ can perform current transformation with small phase difference and small variation of the absolute value of a ratio error, in current measurement biased with half-wave sinusoidal current or direct current. By adjusting the alloy composition, the alternating-current specific initial permeability $\mu_r$ can be 5000 or less, further 4000 or less.

[2] Current Transformer and Power Meter

The current transformer of the present invention comprises the above magnetic core, a primary winding, at least one secondary detection winding, and a load resistor parallel-connected to the secondary detection winding. The primary winding is usually one turn penetrating the core. The current transformer of the present invention can measure half-wave, sinusoidal current, direct-current-biased current, etc. with small absolute values of a phase difference and a ratio error, easy correction and high accuracy. Connected to the detection winding of the current transformer of the present invention is a resistor variable depending on current specification. Particularly, the current transformer of the present invention can perform high-accuracy measurement of half-wave, sinusoidal, alternating current with a phase difference of 5° or less in a rated current range and the absolute value of a ratio error within 3%. Further, the current transformer of the present invention is better in temperature characteristics than conventional ones using Parmalloy or Co-based, amorphous alloys.

The power meter comprising the current transformer of the present invention is adapted to IEC62053-21, a standard usable for distorted waveforms (half-wave rectified waveforms), so that it can perform power measurement of distorted-waveform currents.

The present invention will be explained in more detail referring to Examples below without intension of restricting the present invention thereto.

EXAMPLE 1

An alloy melt of $Fe_{83-x}Co_xCu_xNb_7Si_1B_8$ (by atomic %) was rapidly quenched by a single roll method, to obtain a thin amorphous alloy ribbon of 5 mm in width and 21 μm in thickness. This thin amorphous alloy ribbon was wound to a toroidal core having an outer diameter of 30 mm and an inner diameter of 21 mm. The magnetic core was placed in a heat treatment furnace filled with a nitrogen gas, to carry out a heat treatment while applying a magnetic field of 280 $kAm^{-1}$ in a direction perpendicular to the magnetic circuit of the magnetic core (in the width direction of the thin alloy ribbon, or in the height direction of the magnetic core). A heat treatment pattern used comprised temperature elevation at 10° C./minute, keeping at 550° C. for 1 hour, and cooling at 2° C./minute. Observation by an electron microscope revealed that the heat-treated alloy had a structure, about 70% of which was occupied by crystal grains having a particle size of about 10 nm and a body-cubic crystal structure, part of the crystal phase having a regular lattice. The remainder of the structure was mainly an amorphous phase. An X-ray diffraction pattern indicated peaks corresponding to a body-cubic crystal phase.

This $Fe_{83-x}Co_xCu_1Nb_7Si_1B_8$ (by atomic %) alloy was measured with respect to a magnetic flux density $B_{8000}$ at 8000 $Am^{-1}$, a squareness ratio $B_r/B_{8000}$, coercivity $H_c$, an alternating-current specific initial permeability $\mu_r$ at 50 Hz and 0.05 $Am^{-1}$, and an anisotropic magnetic field $H_K$. The results are shown in FIGS. 1-5. This alloy exhibited a relatively high magnetic flux density $B_{8000}$ when Co was in a range of 3-50 atomic %. The squareness ratio $B_r/B_{8000}$ was as low as 5% or less when Co was in a range of 3-50 atomic %. The coercivity $H_c$ was relatively low when Co was in a range of 3-50 atomic %, but drastically increased when Co exceeded 50 atomic %. The alternating-current specific initial permeability $\mu_r$ decreased as the amount of Co increased, reaching 7000 or less when Co was 3 atomic % or more, and less than 800 when Co exceeded 50 atomic %. The anisotropic magnetic field $H_K$ increased as the amount of Co increased, reaching 150 $Am^{-1}$ or more when Co was 3 atomic % or more, and 1500 $Am^{-1}$ when Co was 50 atomic %.

The magnetic core (x=25 atomic %) was provided with a one-turn primary winding, a 2500-turn secondary detection winding, and a load resistor of 100Ω parallel-connected to the secondary detection winding, to produce a current transformer. Sinusoidal alternating current of 50 Hz and 30 A was supplied to the primary winding to measure a phase difference and a ratio error (expressed by absolute value) at 23° C. As a result, the phase difference θ was 0.5°, and the ratio error RE was 0.1%, at the Co content x of 0 atomic %. Also, the phase difference θ was 1.3°, and the ratio error RE was 0.2%, at the Co content x of 16 atomic %. The phase difference θ was 2.5°, and the ratio error RE was 1.7%, at the Co content x of 25 atomic %. The phase difference θ was 2.6°, and the ratio error RE was 1.1%, at the Co content x of 30 atomic %. Further, how well half-wave, sinusoidal, alternating current having a wave height of 30 A could be measured was evaluated by the following standards. The results are shown in Table 1.

TABLE 1

| | Co Content x (by atomic %) | | | | | | | | | |
|---|---|---|---|---|---|---|---|---|---|---|
| | 0 | 1 | 3 | 16 | 25 | 30 | 40 | 50 | 70 | 80 |
| Measurement | Poor | Poor | Fair | Good | Good | Good | Good | Good | Poor | Poor |

Good: Measured accurately.
Fair: Measured without accuracy.
Poor: Could not be measured.

The current transformer core of the present invention made of the Fe-based, nano-crystalline alloy having a Co content x of 10-50 was able to measure half-wave, sinusoidal, alternating current and direct-current-superimposed current. It also had as small a phase difference as or less, and as small a ratio error as 2% or less as an absolute value.

EXAMPLE 2

Alloy melts having the compositions shown in Table 2 were rapidly quenched by a single roll method in an Ar atmosphere, to obtain thin amorphous alloy ribbons of 5 mm in width and 21 μm in thickness. Each thin amorphous alloy ribbon was wound to a current transformer core having an outer diameter of 30 mm and an inner diameter of 21 mm. Each magnetic core was heat-treated in the same manner as in Example 1, and then subjected to magnetic measurement. In the heat-treated alloy structure, ultrafine crystal grains having a particle size of 50 nm or less were generated. No. 33 represents a magnetic core made of an Fe-based, nano-crystalline alloy (Comparative Example), No. 34 represents a magnetic core made of a Co-based, amorphous alloy (Comparative Example), and No. 35 represents a magnetic core made of Parmalloy (Comparative Example).

With respect to a current transformer produced by using each magnetic core, phase difference and ratio error of rated current (expressed by absolute value), a magnetic flux density $B_{8000}$, a squareness ratio $B_r/B_{8000}$, an alternating-current specific initial permeability $\mu_r$, and an anisotropic magnetic field $H_K$ were measured at 23° C. in the same manner as in Example 1. Further, how well half-wave, sinusoidal, alternating current having a wave height of 30 A could be measured was evaluated by the following standards. The results are shown in Table 2.

TABLE 2

| No. | Composition (by atomic %) | $B_{8000}$ (T) | $B_r/B_{8000}$ (%) | $\mu_r$ |
|---|---|---|---|---|
| 1 | $Fe_{ba1}Co_{30}Cu_1Nb_3Si_9B_9$ | 1.51 | 1 | 2200 |
| 2 | $Fe_{ba1}Co_{15.3}Cu_1Nb_3Si_{10}B_9$ | 1.47 | 1 | 3400 |
| 3 | $Fe_{ba1}Ni_{15.3}Cu_1Nb_{2.5}Si_9B_9$ | 1.28 | 1 | 1700 |
| 4 | $Fe_{ba1}Co_{10}Ni_{10}Cu_{0.8}Nb_{2.5}Si_9B_9$ | 1.38 | 2 | 1900 |
| 5 | $Fe_{ba1}Co_{20}Cu_1Nb_3Si_{13}B_9Mn_{0.5}$ | 1.26 | 1 | 2700 |
| 6 | $Fe_{ba1}Co_{25}Cu_{0.9}Nb_{2.5}Si_{15.5}B_7Cr_{0.5}$ | 1.23 | 1 | 2400 |
| 7 | $Fe_{ba1}Co_{25}Cu_1Nb_{2.8}Si_{16.5}B_7Sn_{0.1}$ | 1.24 | 1 | 2300 |
| 8 | $Fe_{ba1}Co_{25}Cu_1Nb_3Si_{15}B_{6.5}Zn_{0.1}$ | 1.27 | 1 | 2300 |
| 9 | $Fe_{ba1}Co_{25}Cu_{0.6}Nb_{2.6}Si_8B_{10}In_{0.1}$ | 1.59 | 1 | 2400 |
| 10 | $Fe_{ba1}Co_{35}Cu_1Nb_3Si_9B_9Ag_{0.1}$ | 1.52 | 1 | 1800 |
| 11 | $Fe_{ba1}Co_{25}Cu_{0.5}Nb_3Si_{10}B_9Au_{0.5}$ | 1.50 | 1 | 2200 |
| 12 | $Fe_{ba1}Co_{25}Cu_1Nb_3Si_9B_9Sc_{0.1}$ | 1.51 | 1 | 2400 |
| 13 | $Fe_{ba1}Co_{25}Cu_1Nb_3Si_9B_9Pt_{0.1}$ | 1.52 | 1 | 2300 |
| 14 | $Fe_{ba1}Co_{30}Cu_1Nb_3Si_9B_9Pd_{0.1}$ | 1.52 | 1 | 2200 |
| 15 | $Fe_{ba1}Co_{30}Cu_1Nb_2Si_7B_{12}Ru_{0.1}$ | 1.54 | 1 | 2100 |
| 16 | $Fe_{ba1}Co_{30}Cu_1Nb_3Si_9B_9Mg_{0.01}$ | 1.53 | 1 | 2200 |
| 17 | $Fe_{ba1}Co_{30}Cu_1Nb_{2.6}Si_9B_9Ca_{0.01}$ | 1.53 | 1 | 2100 |
| 18 | $Fe_{ba1}Co_{30}Cu_1Nb_{2.7}Si_9B_9Sr_{0.01}$ | 1.52 | 1 | 2100 |
| 19 | $Fe_{ba1}Co_{30}Cu_1Nb_3Si_9B_9C_{0.01}$ | 1.51 | 2 | 2100 |
| 20 | $Fe_{ba1}Co_{30}Cu_1Nb_3Si_9B_9Ge_{0.5}$ | 1.50 | 1 | 2100 |
| 21 | $Fe_{ba1}Co_{30}Cu_1Nb_3Si_{10}B_9Ga_{0.5}$ | 1.52 | 1 | 2200 |
| 22 | $Fe_{ba1}Co_{30}Cu_1Nb_3Si_{10}B_9Al_2$ | 1.49 | 2 | 1800 |
| 23 | $Fe_{ba1}Co_{30}Cu_1Nb_7Si_2B_9P_1$ | 1.71 | 1 | 1100 |
| 24 | $Fe_{ba1}Co_{30}Cu_1Nb_7Si_1B_9Ba_{0.5}$ | 1.72 | 1 | 1200 |
| 25 | $Fe_{ba1}Co_{30}Cu_1Zr_7Si_1B_9Sm_{0.01}$ | 1.70 | 2 | 1100 |
| 26 | $Fe_{ba1}Co_{30}Cu_{0.5}Hf_7Si_9B_9Nd_{0.01}$ | 1.71 | 2 | 1100 |
| 27 | $Fe_{ba1}Co_{30}Cu_{1.5}Ta_3Si_9B_9Be_{0.1}$ | 1.50 | 1 | 2200 |
| 28 | $Fe_{ba1}Co_{30}Cu_1Mo_3Si_{10}B_9$ | 1.48 | 3 | 2100 |
| 29 | $Fe_{ba1}Co_{30}Cu_1Nb_3V_1Si_9B_9$ | 1.47 | 2 | 2000 |
| 30 | $Fe_{ba1}Co_{30}Cu_1W_3Si_{10}B_9$ | 1.46 | 3 | 1900 |
| 31 | $Fe_{ba1}Co_{30}Cu_1Zr_7B_8$ | 1.76 | 2 | 1000 |
| 32 | $Fe_{ba1}Co_{30}Cu_1Zr_7Si_3B_4$ | 1.75 | 3 | 1100 |
| 33* | $Fe_{ba1}Cu_1Nb_3Si_{15.7}B_7$ | 1.2 | 2.6 | 82000 |
| 34* | Amorphous $Co_{ba1}Fe_{1.5}Mn_4Si_5B_{17}$ | 1.0 | 1 | 1500 |
| 35* | Permalloy | 0.75 | 12 | 36000 |

| No. | $H_K$ ($Am^{-1}$) | Ratio Error RE (%) | Phase Difference θ (°) | Measurement |
|---|---|---|---|---|
| 1 | 590 | 2.1 | 2.5 | Good |
| 2 | 326 | 0.1 | 1.2 | Good |
| 3 | 445 | 1.8 | 3.2 | Good |
| 4 | 628 | 0.9 | 1.4 | Good |
| 5 | 429 | 0.8 | 1.3 | Good |
| 6 | 400 | 1.8 | 1.7 | Good |
| 7 | 410 | 1.8 | 2.4 | Good |
| 8 | 420 | 1.7 | 2.5 | Good |
| 9 | 517 | 0.8 | 2.3 | Good |
| 10 | 612 | 1.8 | 3.0 | Good |
| 11 | 500 | 0.9 | 2.4 | Good |
| 12 | 505 | 0.8 | 2.2 | Good |
| 13 | 505 | 0.9 | 2.4 | Good |
| 14 | 495 | 0.9 | 2.4 | Good |
| 15 | 500 | 1.0 | 2.5 | Good |

TABLE 2-continued

| | | | | |
|---|---|---|---|---|
| 16 | 500 | 0.9 | 2.4 | Good |
| 17 | 510 | 1.0 | 2.5 | Good |
| 18 | 500 | 1.1 | 2.5 | Good |
| 19 | 498 | 1.0 | 2.5 | Good |
| 20 | 494 | 1.0 | 2.5 | Good |
| 21 | 506 | 0.9 | 2.3 | Good |
| 22 | 486 | 1.3 | 2.7 | Good |
| 23 | 1150 | 3.0 | 3.6 | Good |
| 24 | 1100 | 2.9 | 3.4 | Good |
| 25 | 1160 | 3.0 | 3.6 | Good |
| 26 | 1180 | 2.9 | 3.4 | Good |
| 27 | 610 | 0.9 | 2.4 | Good |
| 28 | 520 | 1.0 | 2.4 | Good |
| 29 | 550 | 1.2 | 2.8 | Good |
| 30 | 500 | 1.2 | 2.6 | Good |
| 31 | 1200 | 3.0 | 3.7 | Good |
| 32 | 1130 | 2.9 | 3.5 | Good |
| 33* | 12.8 | 0.08 | 0.4 | Poor |
| 34* | 490 | 3.5 | 4.5 | Good |
| 35* | 17.8 | 0.20 | 0.21 | Poor |

Note:
*Comparative Example.
Good: Measured accurately.
Poor: Could not be measured accurately The data in Table 2 indicate that the current transformer core of the present invention has small absolute values of a phase difference and a ratio error, and can be used particularly for an unsymmetrical-waveform current such as half-wave, sinusoidal, alternating current. On the other hand, the magnetic cores made of a conventional Fe-based, nano-crystalline alloy (No. 33) and Parmalloy (No. 35) were difficult to conduct the accurate measurement of half-wave, sinusoidal, alternating current. Also, the magnetic core made of the conventional Co-based, amorphous alloy (No. 34) had larger absolute values of a phase difference and a ratio error than those of the current transformer core of the present invention. It was confirmed that the core of the present invention was able to be used for current transformers in wide ranges of applications such as integrating power meters, industrial equipments, etc.

EXAMPLE 3

An alloy melt of $Fe_{53.8}Co_{25}Cu_{0.7}Nb_{2.6}Si_9B_9$ (by atomic %) was rapidly quenched by a single roll method to obtain a thin amorphous alloy ribbon of 5 mm in width and 21 μm in thickness. This thin amorphous alloy ribbon was wound to a toroidal core having an outer diameter of 30 mm and an inner diameter of 21 mm. The magnetic core was placed in a heat treatment furnace having a nitrogen gas atmosphere, and heat-treated in the same manner as in Example 1, except that the heat treatment pattern comprised temperature elevation at 5° C./minute, keeping at 530° C. for 2 hours, and cooling at 1° C./minute. Observation by an electron microscope revealed that the heat-treated alloy had a structure, about 72% of which was occupied by crystal grains having a particle size of about 10 nm and a body-cubic crystal structure, the balance being mainly an amorphous phase. An X-ray diffraction pattern indicated crystal peaks corresponding to the body-cubic crystal phase.

Measurement revealed that this $Fe_{53.8}Co_{25}Cu_{0.7}Nb_{2.6}Si_9B_9$ (by atomic %) alloy had a magnetic flux density $B_{8000}$ at 8000 $Am^{-1}$ of 1.50 T, a squareness ratio $B_r/B_{8000}$ of 1%, coercivity $H_c$ of 2.1 $Am^{-1}$, an alternating-current specific initial permeability $\mu_r$ of 2200 at 50 Hz and 0.05 $Am^{-1}$, and an anisotropic magnetic field $H_K$ of 406 $Am^{-1}$.

Figure 6:
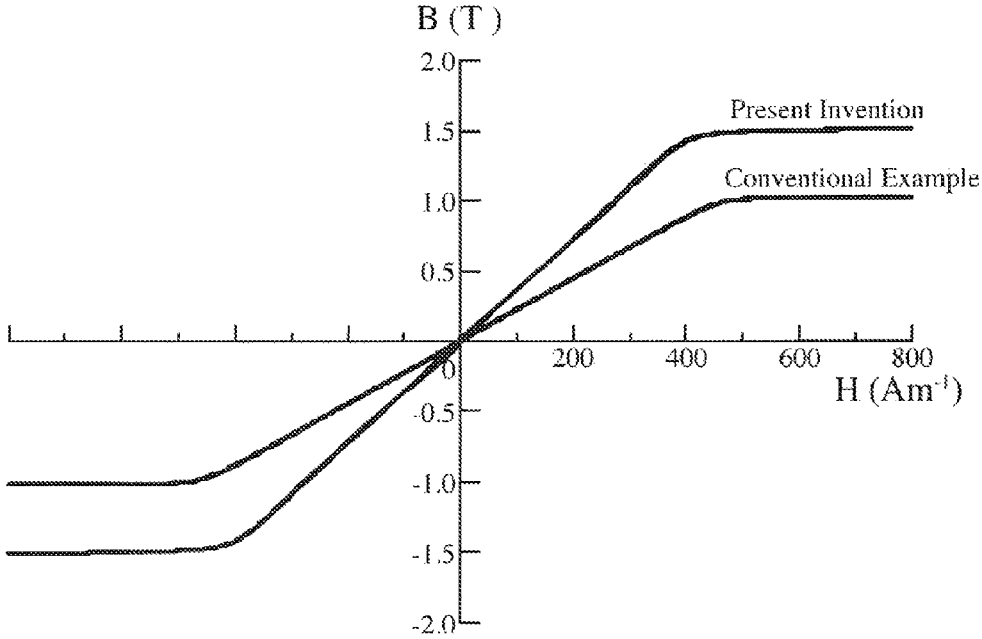
FIG. 6 is a graph showing the direct-current B—H loops of a magnetic core of an $Fe_{53.8}Co_{25}Cu_{0.7}Nb_{2.6}Si_9B_9$ alloy (by atomic %) used in the current transformer of the present invention and a magnetic core of a conventional Co-based, amorphous alloy.
Figure 7:
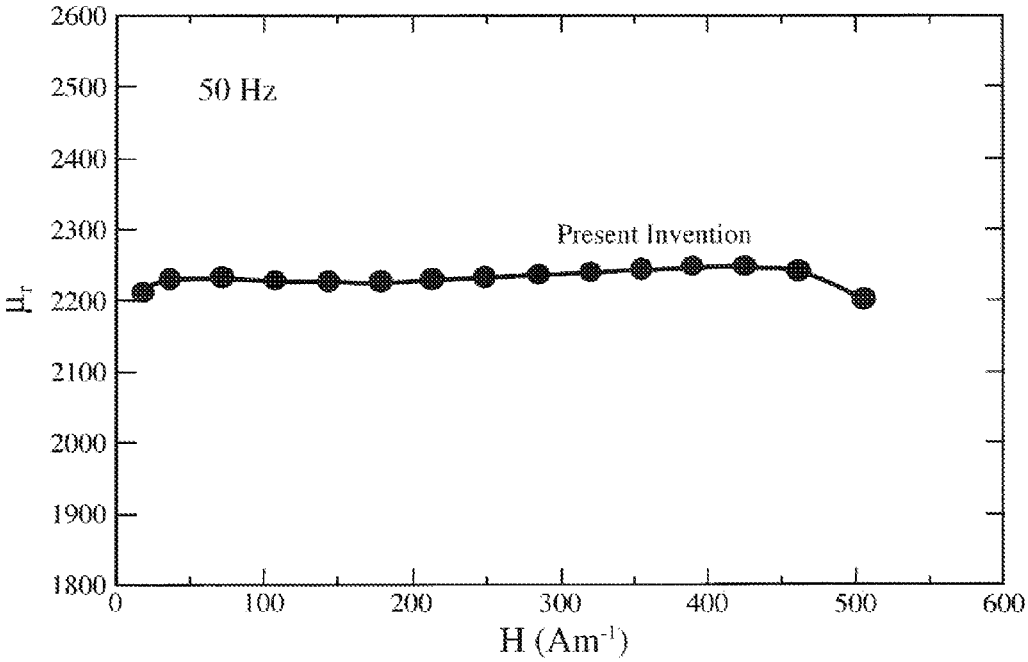
FIG. 7 is a graph showing the dependency of the alternating-current specific initial permeability $\mu_r$ at 50 Hz of a magnetic core of an $Fe_{53.8}$ $Co_{25}Cu_{0.7}Nb_{2.6}Si_9B_9$ alloy (by atomic %) used in the current transformer of the present invention on a magnetic field.
Figure 8:
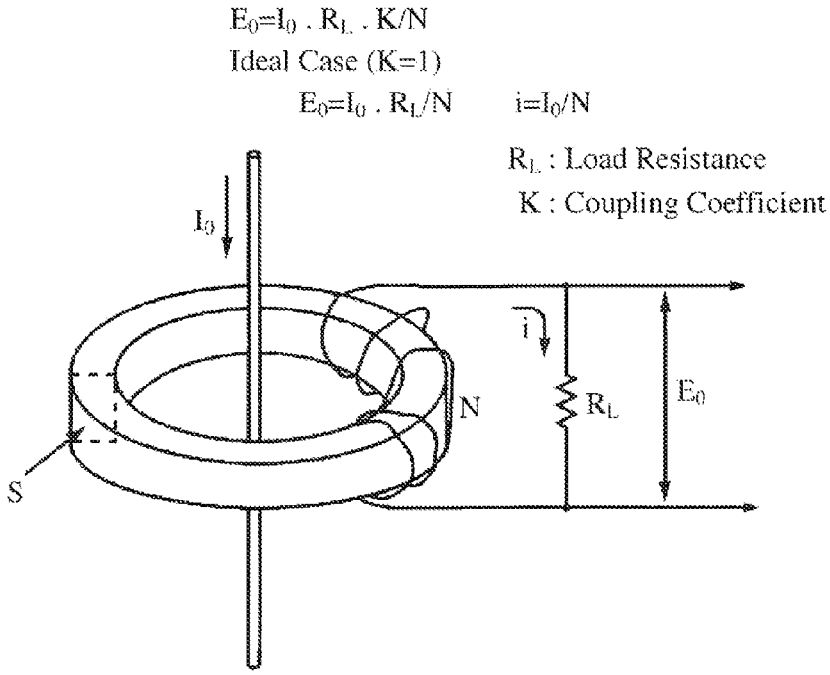
FIG. 8 is a perspective view showing one example of the current transformer (CT)-type current sensor of the present invention.

FIG. 6 shows the direct-current B—H loops of the current transformer core of the present invention and the conventional Co-based amorphous core [No. 34 (Comparative Example) produced in Example 2], and FIG. 7 shows the magnetic field dependency of the alternating-current specific initial permeability $\mu_r$ at 50 Hz of the current transformer core of the present invention. The current transformer core of the present invention exhibited higher alternating-current specific initial permeability $\mu_r$ than that of the Co-based, amorphous alloy core having the same level of $H_K$, and a substantially constant alternating-current specific initial permeability $\mu_r$ in a magnetic field range equal to or less than $H_K$. The current transformer of the present invention using this magnetic core can be used with excellent characteristics even in direct current superposition like half-wave, sinusoidal, alternating current.

Each magnetic core was provided with a one-turn primary winding, a 2500-turn secondary detection winding, and a load resistor of 100Ω parallel-connected to the secondary detection winding, to produce a current transformer. When sinusoidal alternating current of 50 Hz and 30 A was supplied to the primary winding, the absolute values of a phase difference and a ratio error at 23° C. were 2.0% and 2.4° in the current transformer of the present invention, and 3.6% and 4.6° in the current transformer of the Co-based, amorphous alloy.

The power meter produced by using the current transformer of the present invention was able to conduct power measurement not only to positive-negative-symmetrical, sinusoidal, alternating current, but also to half-wave, sinusoidal, alternating current.

EFFECT OF THE INVENTION

The current transformer core of the present invention having a low residual magnetic flux density, small hysteresis, and good magnetization curve linearity, which is not easily saturable and generates a relatively large anisotropic magnetic field $H_K$, provides small, inexpensive, thermally stable current transformers and power meters with wide current measurement ranges. Particularly, it can accurately measure even unsymmetrical-waveform current such as half-wave, sinusoidal, alternating current, and direct-current-superimposed alternating current.

What is claimed is:

1. A current transformer core made of an alloy having a composition represented by the general formula: $Fe_{100-x-a-y-c}M_xCu_aM'_yX'_c$ (by atomic %), wherein M is Co and/or Ni, M' is at least one element selected from the group consisting of V, Ti, Zr, Nb, Mo, Hf, Ta and W, X' is Si and/or B, and x, a, y and c are numbers satisfying $10 \leqq x \leqq 50$, $0.1 \leqq a \leqq 3$, $1 \leqq y \leqq 10$, $2 \leqq c \leqq 30$, and $7 \leqq y+c \leqq 31$, respectively; at least part or all of the alloy structure being composed of crystal grains having an average particle size of 50 nm or less; and said alloy having a magnetic flux density $B_{8000}$ of 1.2 T or more at 8000 $Am^{-1}$, an anisotropic magnetic field $H_K$ of 150-1500 $Am^{-1}$, a squareness ratio $B_r/B_{8000}$ of 5% or less, and an alternating-current specific initial permeability $\mu_r$ of 800-7000 at 50 Hz and 0.05 $Am^{-1}$.

2. The current transformer core according to claim 1, wherein the M content x meets $15 \leqq x \leqq 40$.

3. The current transformer core according to claim 1, wherein the B content is 4-12 atomic %.

4. The current transformer core according to claim 1, wherein the Si content is 0.5-17 atomic %.

5. The current transformer core according to claim 1, wherein part of said M' is substituted by at least one element selected from the group consisting of Cr, Mn, Sn, Zn, In, Ag, Au, Sc, platinum-group elements, Mg, Ca, Sr, Ba, Y, rare earth elements, N, O and S.

6. The current transformer core according to claim 1, wherein part of said X' is substituted by at least one element selected from the group consisting of C, Ge, Ga, Al, Be and P.

7. The current transformer core according to claim 1, wherein it is subjected to a heat treatment in a magnetic field, which comprises keeping it at a temperature of 450-700° C. for 24 hours or less while applying a magnetic field of 40 $kAm^{-1}$ or more in the core height direction, and then cooling it to room temperature.

8. The current transformer core according to claim 1, wherein it is used to detect half-wave, sinusoidal, alternating current.

9. A current transformer comprising the core recited in claim 1, a primary winding, at least one secondary detection winding, and a load resistor parallel-connected to said secondary detection winding.

10. The current transformer according to claim 9, wherein said primary winding has 1 turn.

11. The current transformer according to claim 9, having a phase difference within 5° in a rated current range, and a ratio error within 3% (absolute value) at 23° C.

12. A power meter for multiplying the current value obtained by the current transformer recited in claim 9 and voltage at that time to calculate power used.

* * * * *